US010179968B2

(12) United States Patent
LeBrun et al.

(10) Patent No.: US 10,179,968 B2
(45) Date of Patent: Jan. 15, 2019

(54) WOOL DRYER BALL AND METHOD OF MANUFACTURING SAME

(71) Applicant: Talu Specialty Imports Company Limited, Vancouver (CA)

(72) Inventors: Jennifer Anne LeBrun, Vancouver (CA); Koichi Suzuki, Vancouver (CA)

(73) Assignee: Talu Specialty Imports Company Limited, Vancouver, British Columbia (CA)

( * ) Notice: Subject to any disclaimer, the term of this patent is extended or adjusted under 35 U.S.C. 154(b) by 1278 days.

(21) Appl. No.: 13/665,555

(22) Filed: Oct. 31, 2012

(65) Prior Publication Data

US 2014/0115919 A1 May 1, 2014

(51) Int. Cl.
*D06F 60/00* (2009.01)
*D06F 58/04* (2006.01)

(52) U.S. Cl.
CPC ..... *D06F 60/00* (2013.01); *D06F 58/04* (2013.01)

(58) Field of Classification Search
CPC ..... D06F 58/04; D06F 60/00
See application file for complete search history.

(56) References Cited

U.S. PATENT DOCUMENTS 2,478,232 A 8/1949 Boynton
3,843,395 A * 10/1974 Morton ..... C11D 3/001 427/242
3,944,694 A 3/1976 McQueary
5,611,297 A * 3/1997 Veloce ..... A01K 15/025 119/708
6,174,577 B1 1/2001 Vitorino
6,574,883 B2 6/2003 Giblin
D646,449 S 10/2011 Cheng
2007/0000142 A1 1/2007 Breese
2008/0104856 A1 5/2008 Armstrong
2012/0137535 A1 6/2012 Sieben

FOREIGN PATENT DOCUMENTS

CA 1121111 4/1982
JP 5031297 2/1993

OTHER PUBLICATIONS

Linh, Pure Wool Dryer Balls, Nov. 13, 2011, http://thesoapdispensary.com/pure-wool-dryer-balls/, pp. 1-2.*
Kayla, Wool Dryer Balls How to & Review, Aug. 5, 2011, Mom Up or Go Home, pp. 1-5.*

(Continued)

*Primary Examiner* — Chinessa T. Golden
(74) *Attorney, Agent, or Firm* — McCarthy Tetrault LLP

(57) ABSTRACT

A dryer ball is provided for use in a clothes dryer to reduce clothes drying time. The dryer ball has a substantially spherical wool body and a substantially uniform distribution of wool fibers therethrough. The body has a volume in the range of about 600 $cm^3$ to 930 $cm^3$. A method of manufacturing the dryer ball includes providing a piece of wool material weighing in the range of 54 g to 60 g, folding the piece of wool material into a substantially spherical wool ball having a circumference in the range of 43 cm to 53 cm, sealing the wool ball in a porous bag, washing the wool ball in the bag, removing the wool ball from the bag, and allowing the wool ball to air dry.

18 Claims, 6 Drawing Sheets

(56) References Cited

OTHER PUBLICATIONS

Barb Gadola, Learning to Felt, Jun. 20, 2011, Fleece Fur & Feathers, pp. 1-3.*
BaaLLS Wool Dryer Balls, Online retailer; bynature.ca.
Baby Bear Wool Dryer Balls, Online retailer, www.newandgreen.com.
Baby Bear Wool Dryer Balls, Online retailer, www.happybabycompany.com.
Raw Organics—Organic Wool Dryer Balls, Blog posting, ecocrazymom.com.
Maple Hill Dryer Balls, Online Retailer, www.maplehilldryerballs.com.
Scented CandyShoppe Dryer Balls, Online Retailer, www.gnomesnaturals.com.
BaaLLs: Wool Dryer Balls, Wool Dryer Balls, Nakey Wool Dryer Balls, www.etsy.com.
How to Make Felted Wool Dryer Balls, Crunch Betty, retrieved Aug. 25, 2014 <http://www.crunchbetty.com/how-to-make-felted-wool-dryer-balls>.

* cited by examiner

WOOL DRYER BALL AND METHOD OF MANUFACTURING SAME

TECHNICAL FIELD

This invention relates to dryer balls. Particular embodiments relate to a dryer ball made from wool and a method of manufacturing the dryer ball.

BACKGROUND

As an alternative to using chemical fabric softeners or dryer sheets, dryer balls may be placed in a clothes dryer along with the articles of clothing to be dried. The dryer balls are tossed around in the clothes dryer during the drying cycle and are purported to help fluff and soften clothing.

Some conventional dryer balls are made of heat-resistant plastic or rubber and are covered with outwardly extending knobs or spikes. Examples of such dryer balls include Nellie's™ dryer balls, Dryer Magic™ dryer balls, Dryer Max™ dryer balls and The Original Dryer Balls™. Typically, such dryer balls are about 7.6 cm or 3 inches in diameter, or are about the size of a tennis ball or smaller.

Other dryer balls are made from wool. For example, some dryer balls are made from wool yarn which has been twisted or wound into a ball and felted by washing and drying the ball several times in succession. Typically, wool dryer balls are hard and dense, and are similar in size to plastic dryer balls (e.g. about the size of a tennis ball or smaller). They are generally intended to emulate the function of plastic dryer balls.

A main objective of conventional plastic or wool dryer balls is to soften and fluff clothing by beating the clothing as the balls are tumbled in the clothes dryer along with the clothing. The balls are typically quite heavy so that they can accomplish this objective.

In some cases, conventional plastic and wool dryer balls are purported to also help reduce drying time by separating the clothing as it dries. However, in general, conventional dryer balls have not been shown to reduce drying time by any significant amount.

There is a general desire for a dryer ball that addresses the aforementioned problems.

The foregoing examples of the related art and limitations related thereto are intended to be illustrative and not exclusive. Other limitations of the related art will become apparent to those of skill in the art upon a reading of the specification and a study of the drawings.

SUMMARY

One aspect of the invention provides a method of making a wool dryer ball. The method includes providing a piece of wool material weighing in the range of 54 g to 60 g. In some embodiments, the piece of wool material weighs about 57 g. The piece of wool material is folded into a substantially spherical wool ball having a circumference in the range of 43 cm to 53 cm. In some embodiments, the spherical wool ball has a circumference of about 48 cm.

Folding the piece of wool material may include taking a pair of laterally opposed sections of the piece and folding them over each other so that wool fibers of each section are oriented in substantially perpendicular directions to each other. Sections of the piece may be pulled and stretched and folded toward a middle portion of the piece.

After the piece of wool material has been folded into a ball, the ball is placed in a porous bag. The bag is sealed to contain the wool ball therein. The bag containing the wool ball is washed. In some embodiments the wool ball is washed in hot soapy water, then rinsed. The wool ball is removed from the bag and allowed to air dry.

According to some embodiments, a felting needle may be used to felt the wool ball after it has been formed and prior to washing. In some embodiments, a felting needle may be used to felt the wool ball after washing.

Another aspect of the invention provides a dryer ball for use in a clothes dryer to increase the dryer's efficiency. The dryer ball has a substantially spherical wool body and a substantially uniform distribution of wool fibers therethrough. The body has a volume in the range of about 600 $cm^3$ to 900 $cm^3$ and a weight in the range of 54 g to 60 g. In particular embodiments, the body has a volume of approximately 760 $cm^3$ and a weight of approximately 57 g. The density of the wool ball may be in the range of 0.06 $g/cm^3$ to 0.09 $g/cm^3$. In particular embodiments, the density of the wool ball is about 0.075 $g/cm^3$. A plurality of air pockets is substantially uniformly distributed throughout the wool ball.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive.

DESCRIPTION

Throughout the following description, specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1B:
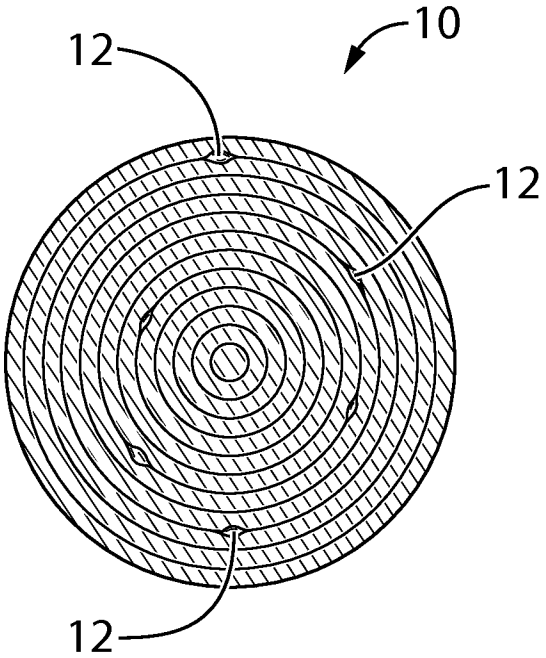
FIG. 1B illustrates a cross-sectional view of the wool dryer ball of FIG. 1A taken along line B-B.
Figure 1A:
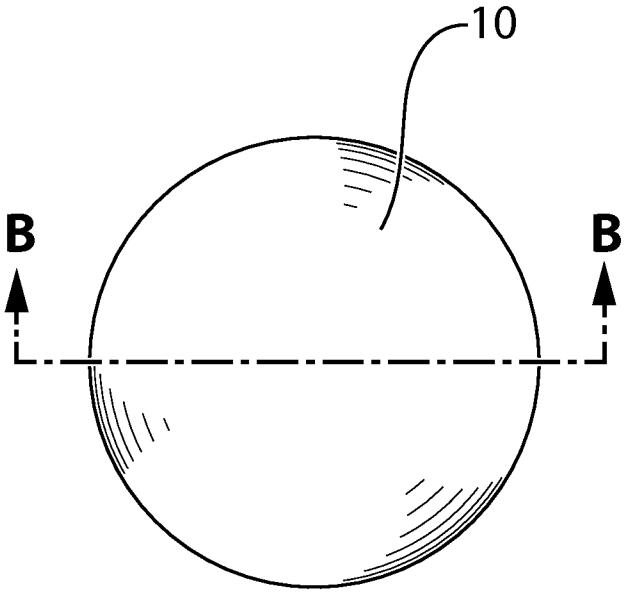
FIG. 1A illustrates a wool dryer ball according to an embodiment of the invention.

FIG. 1A illustrates a dryer ball 10 according to one particular embodiment. In the illustrated embodiment, dryer ball 10 is substantially spherical in shape. In particular embodiments, dryer ball 10 is made entirely of wool. Wool fiber is naturally hydrophilic and can absorb up to about 30% of its own weight in moisture.

The inventors have found that fine, lightweight, soft or fluffy wools are generally suitable for making dryer ball 10. In particular embodiments, dryer ball 10 consists of 100% Merino sheep wool. Dryer ball 10 can be made from other types of sheep wool, such as for example Corriedale wool or Cotswold wool, or from wool obtained from other animals, such as for example alpacas, or any combination of wool thereof.

The tendency is for conventional wool or plastic dryer balls to be hard and dense so that they are effective in beating and softening articles of clothing as they are tumbled in a clothes dryer. In addition, because there is concern that wool will unravel after repeated use in a clothes dryer, conventional wool dryer balls typically consist of wool which has been tightly felted into a highly compact, dense ball so as to reduce the risk of the wool unravelling. Generally, wool balls are laundered in hot water several times to repeatedly felt the wool so that it forms a hard, dense ball.

However, the inventors have found that, for a certain mass of wool material, increasing the size of each wool dryer ball, or decreasing its density, provides particular advantages over conventional wool dryer balls. In particular, the inventors have found that reducing the density of a wool dryer ball reduces the time that it takes to dry clothes when the dryer ball is tumbled in the clothes dryer along with the clothes. A less dense dryer ball contains air pockets or gaps distributed through the ball. Such air pockets in the dryer ball help to trap heat in the dryer ball. This feature helps to distribute the heat generated by the dryer around the interior of the dryer (and hence, around the clothes) during a drying cycle. Such air pockets in the dryer ball also help to increase the absorbency of the dryer ball. The dryer ball absorbs some of the moisture away from the air and the clothes in the clothes dryer.

Accordingly, a dryer ball according to embodiments of the invention described herein is larger and less dense than conventional dryer balls. In addition, the dryer ball is manufactured in such a way that there is little danger of the wool unravelling over use, and without requiring the wool fibers to be tightly felted into a compact, dense ball. The method of manufacture is described below.

In particular embodiments, dryer ball 10 has a circumference of about 35.6 cm (14 inches) or a volume of about 760 $cm^3$ and a weight of about 57 g (2 oz). The density of such dryer ball 10 is therefore about 0.075 $g/cm^3$.

Dryer balls 10 may vary in weight and size. For example, in some embodiments, dryer ball 10 has a weight of 57 g±3 g (2 oz±0.1 oz), and a circumference of about 35.6 cm±2.5 cm (14 inches±1 inch) (i.e. the volume ranges from about 600 $cm^3$ to 930 $cm^3$). However, other variations are possible. For example, in some embodiments, dryer ball 10 may have a weight in the range of 43 g to 85 g (1.5 oz to 3 oz), and a corresponding circumference such that the density of the dryer ball 10 is about 0.075 $g/cm^3$ or within one of the ranges discussed below.

In some embodiments, the weight and size of dryer ball 10 are such that the density of the ball is less than 0.95 $g/cm^3$. In particular embodiments, the weight and size of dryer ball 10 are such that the density of the ball is less than 0.85 $g/cm^3$. In some embodiments, the density of dryer ball 10 is in the range of 0.06 $g/cm^3$ to 0.09 $g/cm^3$. In some embodiments, the density of dryer ball 10 is in the range of 0.06 $g/cm^3$ to 0.08 $g/cm^3$.

FIG. 1B illustrates a cross-sectional view of dryer ball 10 taken along line B-B of FIG. 1A. As illustrated in FIG. 1B, dryer ball 10 has a plurality of air pockets 12. The air pockets 12 may be substantially uniformly distributed throughout the ball. As discussed above, air pockets 12 help to trap heat in the dryer ball 10. Air pockets 12 also increase the absorbency of dryer ball 10.

Figure 2B:
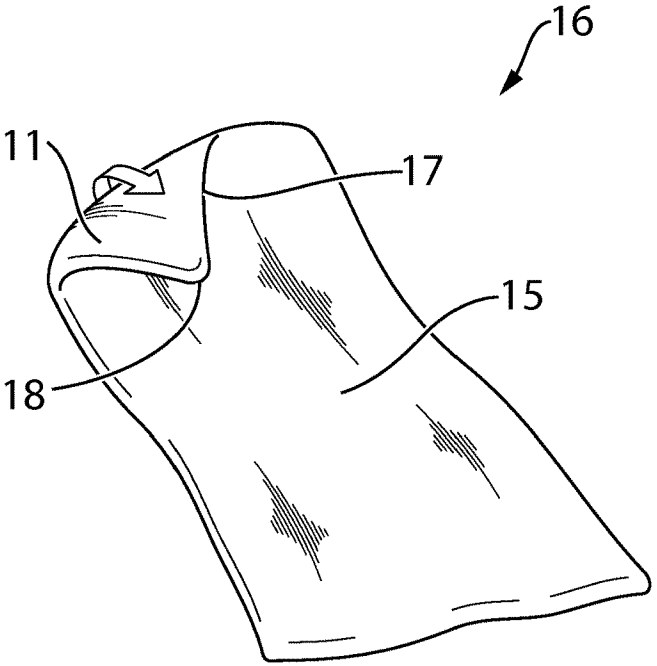
FIGS. 2A to 2D illustrate various stages of forming a piece of wool material into a ball according to one method of making a wool dryer ball.
Figure 2A:
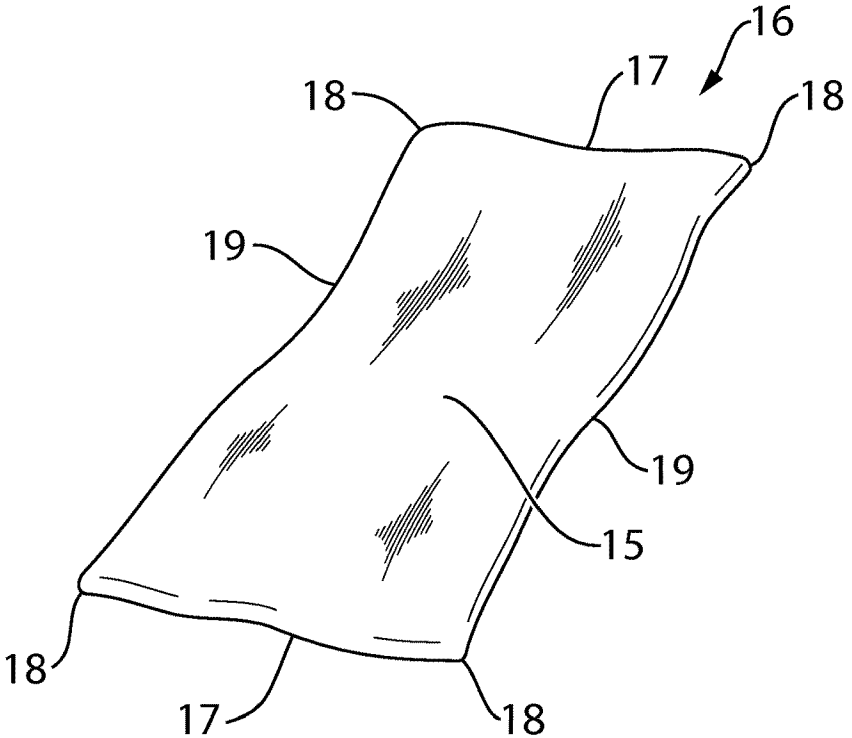

FIGS. 2A to 2D illustrate various stages of forming a piece 16 of wool material into a ball according to a method of manufacturing a dryer ball 10. In FIG. 2A, the piece of wool material comprises wool batting. A larger sheet of wool batting may be cut, separated or otherwise divided into individual wool pieces 16. According to some embodiments, each individual piece 16 weighs about 57 g. Other forms of wool, such as wool roving and wool roping, may be used instead of wool batting.

In the illustrated embodiment of FIG. 2A, each piece 16 is a roughly rectangular sheet, having a pair of longitudinally opposed edges 17 and a pair of laterally opposed edges 19. Adjacent edges 17, 19 meet at their respective corners 18. It is not necessary that piece 16 have the shape as illustrated in FIG. 2A. In other embodiments, piece 16 may be irregular in shape or have a non-rectangular shape.

To start rolling each wool piece 16 into a dryer ball 10, the wool at a corner 18 at one edge 17 is pulled to stretch out the wool material, then folded and/or rolled toward a middle portion 15 of piece 16 to begin forming a body 11 of the ball (see FIG. 2B). The wool at opposite corner 18 of the same edge 17 is pulled to stretch out the wool material, and then folded and/or rolled around body 11 (see FIG. 2C).

Figure 2D:
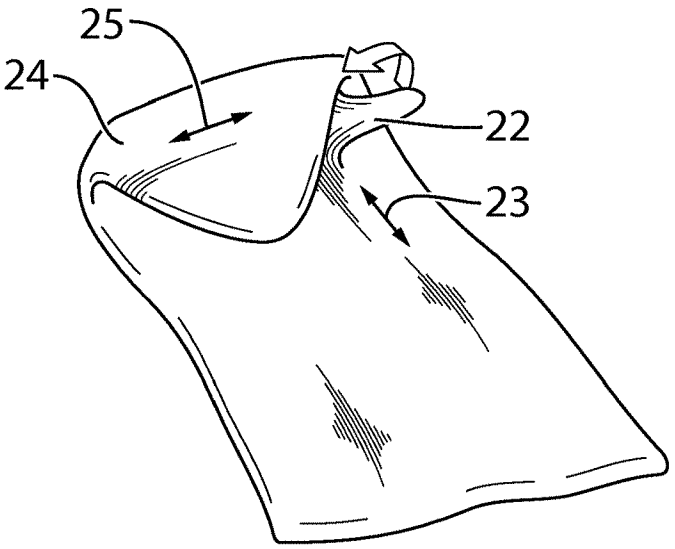

These steps of pulling and stretching, and folding and rolling, are repeated for opposed sections of piece 16 so as to build the body 11 of dryer ball 10. By taking laterally opposed sections of wool along edges 19 and folding or rolling them around body 11, a ball can be formed with fibers oriented in different directions. For example, as illustrated in FIG. 2D, one section 22 of wool having fibers oriented in one direction 23 may be overlaid by another section 24 of wool having fibers oriented in a direction 25 that is substantially perpendicular to direction 23. Wrapping and rolling the wool so that the wool fibers are oriented in different directions will facilitate the felting or binding of the wool fibers during the wet felting stage.

Figure 2C:
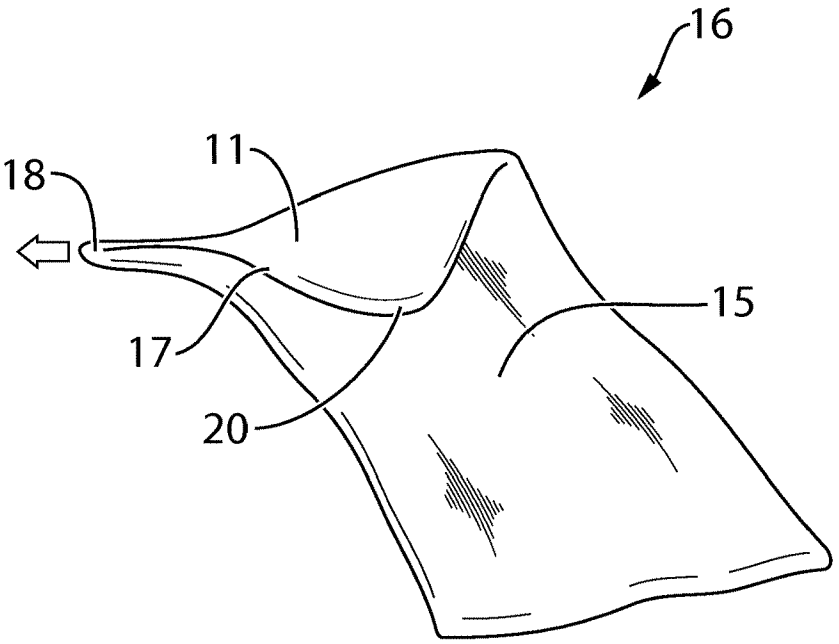

As seen in FIG. 2C, one or more peaks 20 may develop in the body 11 as the wool piece 16 is being folded into a ball. While body 11 is being built, pieces of wool piece 16 can be stretched and wrapped around or over peaks 20 that have developed in body 11 to smooth out such peaks and ensure a round shape to body 11.

To complete the building of body 11, the last sections of wool at the two corners 18 of edge 17 may be pulled and stretched and then folded around body 11. These wool sections may be wrapped around body 11 in different directions.

Care should be taking during the stage of forming wool piece 16 into a ball 10 to ensure that the wool is not folded or wrapped too tightly, otherwise the result may be an overly dense wool ball that is not effective in reducing drying time. In particular embodiments, the result of the ball forming steps described above should be a substantially spherical ball 10 having a circumference in the range of 43 cm to 53 cm (17 inches to 21 inches). In particular embodiments, the dryer ball 10's circumference is about 48 cm (19 inches). Dryer ball 10 should feel soft and spongy.

Figure 3:
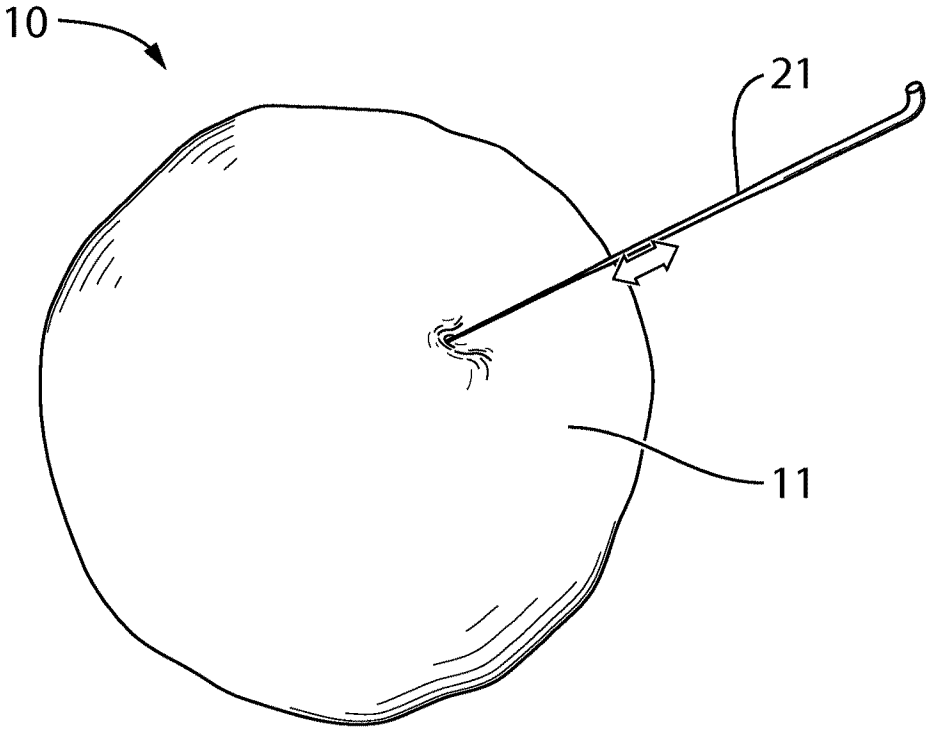
FIG. 3 illustrates a needle felting step of a method of making a wool dryer ball.

FIG. 3 illustrates the needle felting step in a method of manufacturing dryer ball 10. After the ball 10 has been formed by the steps described above with reference to FIGS. 2A to 2D, a felting needle 21 can optionally be used to weave loose wool fibers into body 11. The felting needle 21 can be used to pull fibers over or into any visible openings in body 11, or to pull and weave fibers into the ball which are not flush against body 11.

The dryer ball 10 is then inserted in a bag or sac 28. Bag 28 is made of porous material. Such material may comprise, for example, nylon material. In the illustrated embodiment of FIG. 4A, bag 28 is a nylon stocking having a closed end 26 and an open end 27. Ball 10 is inserted in bag 28 through open end 27 and moved toward closed end 26, working out any wrinkles or folds that may develop by stretching and pulling the nylon material over ball 10. Any loose fibers caught in the nylon material can be pushed or patted into place.

Figure 4B:
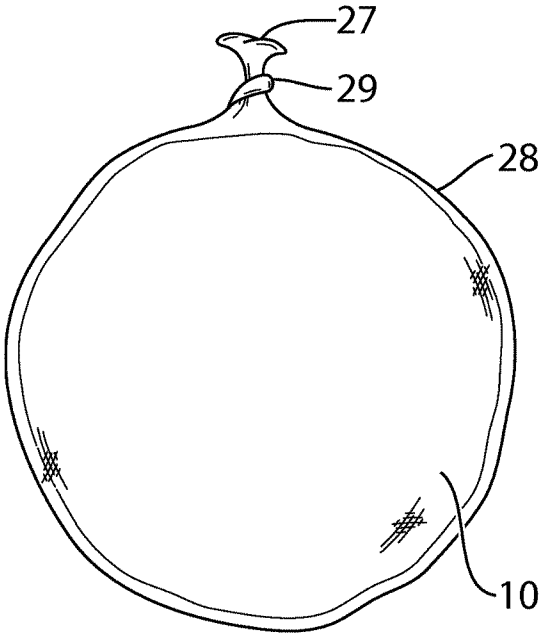
FIGS. 4A and 4B illustrate wet felting apparatus used in a method of making a wool dryer ball.
Figure 4A:
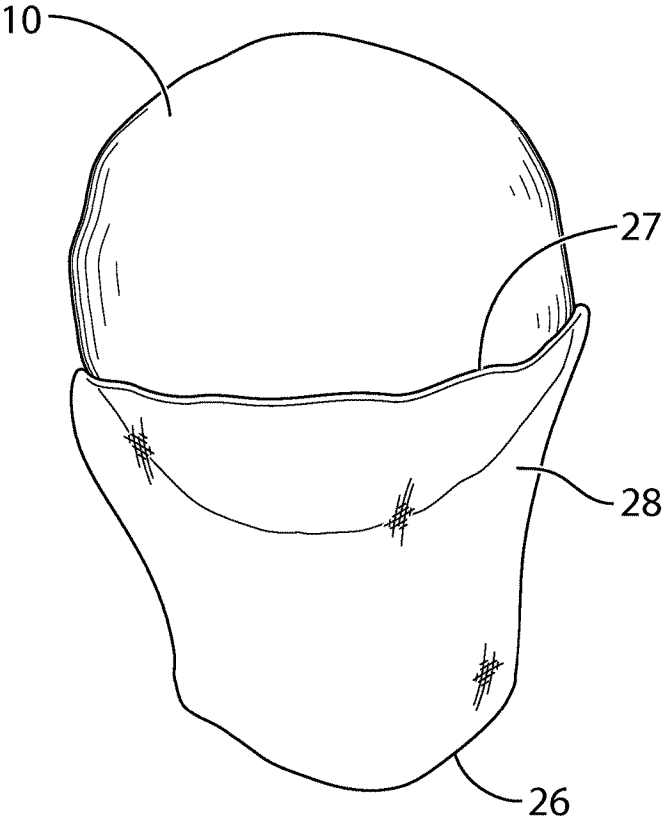

Once ball 10 is in the bag, open end 27 of bag 28 is closed. This can be accomplished by twisting and tying a knot 29 in the stocking as shown in FIG. 4B.

Dryer ball 10 is now ready to undergo the wet felting stage. In this stage, bags 28 containing dryer balls 10 are submerged in water and washed to lubricate and stimulate the wool fibers so that they bond with one another. In particular embodiments, dryer balls 10 are washed in hot water to agitate the wool fibers so that they bond together in a process known as felting. For some embodiments, the water for washing the balls may be heated to a temperature in the range of 40° C. to 60° C. In some embodiments, a small amount of soap, such as a laundry detergent, is added to the water in which the balls are submerged and washed to help lubricate the fibers and encourage the fibers to move and bond together.

A clothes washing machine or other suitable machine can be used for the wet felting stage. In some embodiments, a number of dryer balls 10 contained in their respective bags 28 may be wet felted at the same time. For example, where a clothes washing machine is used, thirty (30) dryer balls may be placed in the washing machine at once. In some embodiments, the wash cycle may last between about 30 minutes and 60 minutes.

Following a wash in hot soapy water, dryer balls 10 are rinsed with cold water to remove the soap and stop the felting process. Bags 28 are opened, and dryer balls 10 are removed from the bags and allowed to air dry. In some embodiments, dryer balls 10 are allowed to dry for about 24 hours. The finished, dried dryer balls 10 have a substantially uniform distribution of wool fibers throughout. In addition, dryer balls 10 contain air pockets 12, as shown in FIG. 1B.

Dryer balls 10 may be inspected after removal from the bags. Any loose fibers or sections requiring further felting may be needle felted. A few drops of essential oil or other fragrance may optionally be added to dryer ball 10 by the manufacturer or the consumer to freshen the laundry with a scent. Otherwise, dryer ball 10 can be left unscented.

In particular embodiments, dryer balls 10 are wet felted only once (i.e. they undergo only a single wash in hot soapy water, followed by a rinse in cold water). In such embodiments a single wet felting step is generally sufficient to cause the wool fibers in dryer ball 10 to matt together so that the ball keeps its shape while being used in a clothes dryer.

After a single wet felting step, dryer balls 10 will have typically shrunk from their pre-wetfelting size. For example, in particular embodiments, dryer balls 10 shrink from a circumference of about 48 cm±5 cm (19 inches±2 inches) prior to wet felting, to a circumference of about 35.6 cm±2.5 cm (14 inches±1 inch) after wet felting. In other embodiments, dryer balls 10 shrink to a circumference of about 38 cm±2.5 cm (15 inches±1 inch) after wet felting. After wet felting, dryer ball 10 should still feel quite spongy and contain air pockets 12. It is important that dryer balls 10 are not over-felted, for example, by washing too long in the hot soapy water, or using too high a temperature for the water, so as to cause the wool to become compacted and overly dense. Wet felting a dryer ball 10 more than once may increase the density of the ball such that the ball is no longer as effective at reducing drying time. A dryer ball 10 need only be sufficiently felted so that the wool fibers in the ball are bonded together and the ball keeps its shape while tumbled in the dryer. The temperature of the hot water and duration of the wash for the wet felting stage may be controlled such that dryer balls 10 shrink to a particular circumference after wet felting, such as for example, a circumference of about 35.6 cm (14 inches).

Figure 5:
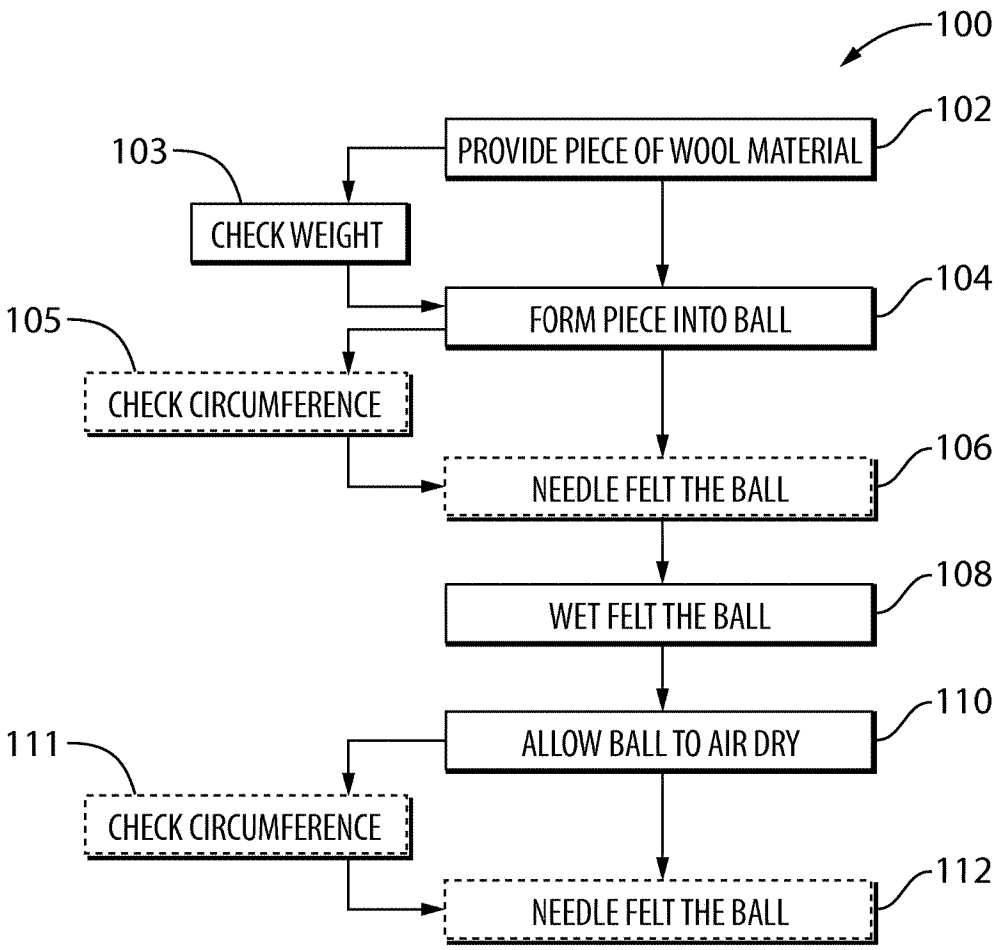
FIG. 5 is a flowchart illustrating a method of manufacturing a wool dryer ball according to an embodiment of the invention.

FIG. 5 illustrates a method 100 of manufacturing a dryer ball 10 according to an embodiment of the invention. Method 100 begins by providing a piece of wool material at block 102. The piece is weighed at block 103 to ensure that it is the desired weight. For example, in particular embodiments, each piece should weigh about 57 g (2 oz).

At block 104, the piece is formed into a ball. One method for implementing block 104 is described above with reference to FIGS. 2A to 2D. The formed ball is optionally measured at block 105 to ensure that it is of a desired circumference. A ball that is too tightly wrapped may be too dense to be effective in reducing drying time. In some embodiments, after it is formed at block 104 dryer ball 10 has a circumference in the range of 43 cm to 53 cm (17 inches to 21 inches). In particular embodiments, the dryer ball 10's circumference is about 48 cm (19 inches).

Method 100 proceeds to block 106 by needle felting the ball where needed (e.g. to tuck in any loose fibers or fill in any visible openings in the ball). This step is described above with reference to FIG. 3. The step at block 106 is optional.

Method 100 then proceeds to the wet felting stage at block 108, by placing the ball in a bag and washing the ball while it is in the bag. This step is described above with reference to FIGS. 4A and 4B.

After wet felting, the ball is removed from the bag and allowed to air dry at block 110. The drying stage may take about 24 hours. For quality control purposes, the ball is optionally measured at block 111 to ensure that it is of a desired circumference. In some embodiments, for a 57 g (2 oz) dryer ball, the ball should have a circumference of about 35.6 cm (14 inches) after wet felting. The ball is optionally finished by needle felting where needed at block 112.

Three dryer balls 10 made according to the method described herein may be placed inside a clothes dryer to reduce drying time. The inventors have found that, depending on the characteristics of the dryer and clothes being dried, three dryer balls 10 placed in the dryer during the drying cycle may reduce drying time by as much as 30% to 50% as compared to drying the same load in the dryer without dryer balls 10. Dryer balls 10 in some cases work best in reducing drying time for clothes made from natural fibers, such as cotton, rather than non-natural fibers (like acrylic or polyester or polyester blends).

While some suppliers of conventional wool dryer balls advise using as many as 6 to 12 or more dryer balls for each load of laundry, it has been found that due to the particular properties of dryer balls 10 according to embodiments described herein, placing three dryer balls 10 in the dryer may be generally sufficient to reduce drying time by a noticeable amount (e.g. for certain laundry loads and dryers, the inventors have observed a 30% or greater reduction in drying time by using three dryer balls 10).

Dryer balls 10 may shrink in size after many uses to a point where they are no longer effective at reducing drying time. It has been found by the inventors that for maintaining adequate performance of the dryer balls, each dryer ball 10 should be replaced with a new ball after a certain number of uses. For example, dryer balls 10 made from Merino wool according to the methods described herein should be replaced after 100 uses.

Wool has a number of properties which make it suitable for use as a material for dryer balls 10. For example, wool is:

- hydrophilic and can absorb up to 30% of its own weight in moisture;
- resistant to static electricity;
- fire resistant;
- elastic (which keeps the dryer ball durable and helps the ball to retain its shape);
- dirt resistant due to the small scales on the surface of the fiber which hold the dirt near the surface of the fiber;
- odor repellant; and
- able to felt due to the small scales on the surface of the wool fiber as well as other factors such as the waviness or crimp of the wool fiber.

As will be appreciated upon reading this description, the apparatus and methods described herein provide a number of benefits. For example, dryer balls 10 can reduce electricity consumption by reducing drying time. Dryer balls 10 can help to dry clothes more evenly and more efficiently since dryer balls 10 separate the clothing, and absorb moisture and distribute heat around the dryer as facilitated by the distribution of air pockets 12 in dryer balls 10 and the low density of dryer balls 10. In addition, dryer balls 10 may help to reduce static build-up in the clothes. Dryer balls 10 may help to reduce wrinkles in the clothes. Since dryer balls 10 are made of natural materials, namely wool fibers, they can be used by those who are sensitive to chemicals.

Dryer ball 10 can be made from one or more types of wool. For example, as discussed above, particular embodiments of dryer ball 10 are made from Merino sheep wool. Other types of sheep wool or a wool blend or wool from other animals (e.g. alpacas) may be selected to make dryer ball 10. The inventors have found that the effectiveness of dryer ball 10 may vary based on the properties of the wool material that is selected. For example, the fineness or coarseness of the wool fiber varies between different types of wool and can affect the absorbency and density of dryer ball 10. In general, finer wool (such as Merino, which has a fiber diameter of between 17-24 microns) may be formed into less dense and more absorbent balls than as compared with relatively coarser wool (such as Corriedale, which has a fiber diameter of between 25-33 microns). Some finer wools may also felt gradually and are better able to retain their shape in the dryer than other kinds of wool which have a greater tendency to felt and to shrink with use in the dryer. For example, dryer balls 10 made from Corriedale wool according to the methods described herein have been found by the inventors to reduce drying time, but typically do not have a useful lifespan as long as dryer balls made from Merino wool given the aforementioned differences in the wool properties causing the Corriedale wool balls to continue felting and shrinking after fewer uses in the dryer.

While a number of exemplary aspects and embodiments have been discussed above, those of skill in the art will recognize certain modifications, permutations, additions and sub-combinations thereof. It is therefore intended that the scope of the following appended claims and claims hereafter introduced should not be limited by the embodiments set forth in the examples, but should be given the broadest interpretation consistent with the description as a whole.

What is claimed is:

1. A dryer ball for use in a clothes dryer to increase the dryer's efficiency, comprising a spongy, substantially spherical wool body having a plurality of air pockets substantially uniformly distributed throughout, the body being defined by at least one wool sheet section overlaid by another wool sheet section and having a density in the range of 0.06 g/cm$^3$ to 0.08 g/cm$^3$, wherein the wool body is hydrophilic and absorbs up to 30% of its own weight in moisture during use inside the clothes dryer.

2. A dryer ball according to claim 1, wherein the body has a volume in the range of 600 cm3 to 930 cm3 and a weight in the range of 54 g to 60 g.

3. A dryer ball according to claim 1, wherein the body has been wet felted only once.

4. A dryer ball according to claim 1, wherein the body comprises Merino wool.

5. A dryer ball according to claim 1, wherein the body comprises alpaca wool.

6. A kit for increasing efficiency of a clothes dryer, the kit comprising three dryer balls according to claim 1.

7. A method of manufacturing a dryer ball according to claim 1, comprising:

(a) providing a piece of wool material weighing in the range of 54 g to 60 g;
(b) folding the piece of wool material into a substantially spherical wool ball having a circumference in the range of 43 cm to 53 cm;
(c) placing the wool ball in a porous bag;
(d) sealing the bag to contain the wool ball therein;
(e) washing the wool ball;
(f) removing the wool ball from the bag; and,
(g) air drying the wool ball.

8. A method according to claim 7, wherein folding the piece of wool material comprises taking a pair of laterally opposed sections of the piece and folding them over each other so that wool fibers of each section are oriented in substantially perpendicular directions to each other.

9. A method according to claim 7, wherein folding the piece of wool material comprises stretching a section of the piece and folding the stretched section toward a middle portion of the piece.

10. A method according to claim 7 comprising using a felting needle to felt the wool ball after it has been folded and prior to washing.

11. A method according to claim 7 comprising using a felting needle to felt the wool ball after washing.

12. A method according to claim 7, wherein the bag is a nylon stocking.

13. A method according to claim 7, wherein the piece of wool material weighs 57 g, and the piece of wool material is folded into a substantially spherical wool ball having a circumference of 48 cm.

14. A method according to claim 7, wherein washing the wool ball comprises submerging the bag in hot water.

15. A method according to claim 14, wherein soap is added to the hot water.

16. A method according to claim 15, wherein a temperature of the hot water and a duration for washing the wool ball is such that the wool ball has a circumference in the range 33 cm to 38 cm subsequent to washing the wool ball.

17. A method according to claim 7, wherein providing the piece of wool material comprises providing a sheet of wool batting or wool roving.

18. A method according to claim 7, wherein providing the piece of wool material comprises providing a piece of Merino wool.

* * * * *